US008727494B2

(12) United States Patent
Noda

(10) Patent No.: US 8,727,494 B2
(45) Date of Patent: May 20, 2014

(54) DROPLET EJECTION DEVICE AND IMAGE FORMING APPARATUS

(71) Applicant: Hiroshi Noda, Kanagawa (JP)

(72) Inventor: Hiroshi Noda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/688,773

(22) Filed: Nov. 29, 2012

(65) Prior Publication Data

US 2013/0162718 A1 Jun. 27, 2013

(30) Foreign Application Priority Data

Dec. 27, 2011 (JP) ..... 2011-286962

(51) Int. Cl.
*B41J 2/14* (2006.01)

(52) U.S. Cl.
USPC ..... 347/47

(58) Field of Classification Search
USPC ..... 347/20, 92, 103, 47
See application file for complete search history.

(56) References Cited

U.S. PATENT DOCUMENTS

| | | | | |
|---|---|---|---|---|
| 4,376,944 | A * | 3/1983 | Reitberger et al. | 347/47 |
| 4,589,000 | A * | 5/1986 | Koto et al. | 347/68 |
| 5,745,129 | A * | 4/1998 | Moriyama et al. | 347/12 |
| 6,081,281 | A * | 6/2000 | Cleary et al. | 347/21 |
| 6,257,700 | B1 * | 7/2001 | Aihara et al. | 347/44 |
| 6,663,230 | B2 * | 12/2003 | Asakawa et al. | 347/65 |
| 8,079,673 | B2 * | 12/2011 | Urasaki | 347/65 |
| 8,333,464 | B2 * | 12/2012 | Hirato | 347/96 |
| 8,342,661 | B2 * | 1/2013 | Takahashi et al. | 347/85 |
| 2004/0100520 | A1 * | 5/2004 | Kimura | 347/30 |
| 2004/0257410 | A1 * | 12/2004 | Yamada et al. | 347/84 |
| 2005/0270318 | A1 | 12/2005 | Noda | |
| 2007/0052775 | A1 * | 3/2007 | Jung | 347/86 |
| 2007/0097163 | A1 | 5/2007 | Shingyohuchi et al. | |
| 2008/0218571 | A1 * | 9/2008 | Nishimori | 347/92 |
| 2009/0115825 | A1 * | 5/2009 | Peng et al. | 347/92 |
| 2009/0189958 | A1 * | 7/2009 | Ogata | 347/70 |
| 2009/0295870 | A1 * | 12/2009 | Goin et al. | 347/47 |
| 2010/0060688 | A1 * | 3/2010 | Hirato | 347/14 |
| 2011/0050814 | A1 * | 3/2011 | Tsubaki et al. | 347/85 |
| 2012/0007918 | A1 * | 1/2012 | Ohtsu et al. | 347/45 |
| 2012/0098908 | A1 * | 4/2012 | Xie et al. | 347/90 |

FOREIGN PATENT DOCUMENTS

| | | |
|---|---|---|
| JP | 63-189636 | 12/1988 |
| JP | 5-193156 | 8/1993 |

(Continued)

OTHER PUBLICATIONS

U.S. Appl. No. 13/558,827, filed Jul. 26, 2012, Hiroshi Noda.

*Primary Examiner* — Matthew Luu
*Assistant Examiner* — Patrick King
(74) *Attorney, Agent, or Firm* — Cooper Dunham LLP

(57) ABSTRACT

A droplet ejection device includes a droplet ejection head. The droplet ejection head includes droplet ejection nozzles, a common liquid chamber, an air vent nozzle, and a nozzle face. The ejection nozzles are arranged side by side in a vertical direction. Each ejection nozzle has a first channel to eject droplets. The vent nozzle has a second channel to vent air from the common chamber. The nozzle face is disposed in the vertical direction or a direction tilted downward relative to the vertical direction. The first channel is tilted downward so that a side proximal to the nozzle face is lower than another side proximal to the common chamber. The vent nozzle is disposed above a topmost one of the ejection nozzles. The second channel is tilted upward so that a side proximal to the nozzle face is higher than another side proximal to the common chamber.

5 Claims, 7 Drawing Sheets

(56) References Cited

FOREIGN PATENT DOCUMENTS

| | | |
|---|---|---|
| JP | 6-143565 | 5/1994 |
| JP | 7-32612 | 2/1995 |
| JP | 9-207354 | 8/1997 |
| JP | 11-78046 | 3/1999 |
| JP | 2004-255862 | 9/2004 |
| JP | 2010-17997 | 1/2010 |
| JP | 2012-121147 | 6/2012 |

* cited by examiner

DROPLET EJECTION DEVICE AND IMAGE FORMING APPARATUS

CROSS-REFERENCE TO RELATED APPLICATIONS

This patent application is based on and claims priority pursuant to 35 U.S.C. §119 to Japanese Patent Application No. 2011-286962, filed on Dec. 27, 2011, in the Japan Patent Office, the entire disclosure of which is hereby incorporated by reference herein.

BACKGROUND

1. Technical Field

This disclosure relates to a droplet ejection device and an image forming apparatus including the droplet ejection device, and more specifically to a droplet ejection device capable of removing bubbles contained in liquid and an image forming apparatus including the droplet ejection device.

2. Description of the Related Art

Image forming apparatuses are used as printers, facsimile machines, copiers, plotters, or multi-functional devices having two or more of the foregoing capabilities. Such image forming apparatuses may have a droplet ejection device that uses a droplet ejection head as a recording head to eject droplets of ink or other liquid.

Such a droplet-ejection type of image forming apparatus typically, while conveying a recording medium (e.g., a recording sheet of paper), ejects liquid droplets from the recording head and attaches or penetrates the droplets onto the recording medium for image formation. The recording medium (target) is not limited to the above-described recording sheet of paper but is made of string, fiber, leather, metal, resin, glass, timber, ceramic, or any other material on which liquid is attachable or penetrable.

For example, inkjet printers, one type of image forming apparatuses including such a droplet ejection device, may supply ink from an ink tank removably mounted in a printer body to a recording head on a carriage through a flexible tube. However, ink supplied through the flexible tube may contain bubbles mixed during filling of ink to the ink tank. Such bubbles may aggregate and grow up, thus causing ejection failure of liquid droplets or degraded image quality.

To prevent ink containing bubbles from being supplied to nozzles of a recording head, for example, JP-3186353-B (H07-032612-A) proposes to provide a trap portion forming a storage space in an ink supply passage to trap bubbles and a suction pump to discharge trapped bubbles to the outside.

In such a configuration, when bubbles mixed in ink supplied through the supply passage move to the trap portion by flotation, the suction pump discharges the bubbles to the outside to maintain ink in the nozzles in a bubble free state.

As one variation of the above-described configuration, for example, JP-H11-078046-A proposes an inkjet recording apparatus having an ink feed passage in an ink feed needle inserted into the ink cartridge and an introduction passage communicated with a recording head at a position offset from the ink feed passage. The inkjet recording apparatus also has a filter in an ink passage connecting the ink feed passage to the introduction passage and a bubble guide groove of a downward recessed shape formed in a ceiling face of the ink passage at an upper face side of the filter to guide and store bubbles in a bubble guide channel. As another variation of the above-described configuration, for example, JP-2004-255862-A proposes an inkjet printer having bubble discharge passages communicated with nozzles of a recording head.

In each of the above-described configurations, a bubble trap portion is formed in an ink feed (supply) passage to prevent bubbles from staying in ink supplied to a recording head.

However, for example, the configuration described in JP-3186353-B (H07-032612-A) needs not only components for ink supply but also components for bubble discharge, e.g., a suction pump, thus resulting in a relatively complex structure and increased size and cost.

Unlike the configuration of JP-3186353-B (H07-032612-A), the configuration described in JP-H11-078046-A does not have a dedicated bubble discharge means. However, it is necessary to remove bubbles accumulated in the bubble guide groove, in other words, bubbles adhered on the filter that may hamper ink supply. Hence, at initial ink filling or replacement of the ink cartridge, the inkjet recording apparatus of JP-H11-078046-A forcefully flows ink toward the ink feed passage to move bubbles from the introduction passage to the ink feed passage.

The configuration of JP-H11-078046-A is mainly intended to move bubbles away from a position of the filter opposing the introduction passage rather than to discharge bubbles to the outside. In other words, a main purpose of the configuration is to minimize bubbles adhered on the filter to secure the ink supply amount. As a result, bubbles might not be removed depending on the size of bubbles, thus blocking a portion of the ink passage proximal to the introduction passage at the restart of ink supply.

In other words, any of the above-described configurations described in JP-3186353-B (H07-032612-A) and JP-H11-078046-A supposes to move bubbles toward nozzles and does not deal with negative effect caused by bubbles moved to the nozzles.

BRIEF SUMMARY

In an aspect of this disclosure, there is provided a droplet ejection device including a droplet ejection head. The droplet ejection head includes a plurality of droplet ejection nozzles, a common liquid chamber, an air vent nozzle, and a nozzle face. The plurality of droplet ejection nozzles is arranged side by side in a vertical direction. Each of the plurality of droplet ejection nozzles has a first channel to eject droplets of liquid to a target. The common liquid chamber is communicated with the first channel of the each of the plurality of droplet ejection nozzles to supply the liquid to the first channel of the each of the plurality of droplet ejection nozzles. The air vent nozzle has a second channel to vent air from the common liquid chamber. The nozzle face includes the plurality of droplet ejection nozzles and the air vent nozzle. The nozzle face is disposed in the vertical direction or a direction tilted downward relative to the vertical direction so that droplets of the liquid are ejected from the plurality of droplet ejection nozzles in a horizontal direction or in a direction tilted relative to the horizontal direction. The first channel is tilted downward so that a side proximal to the nozzle face is lower than another side proximal to the common liquid chamber. The air vent nozzle is disposed above a topmost one of the plurality of droplet ejection nozzles. The second channel is tilted upward so that a side proximal to the nozzle face is higher than another side proximal to the common liquid chamber.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
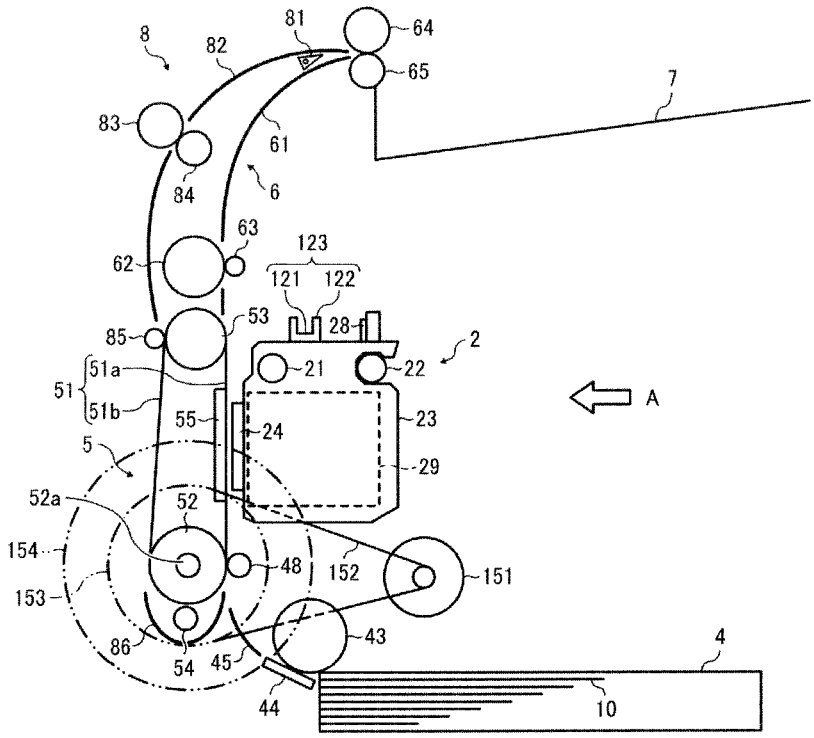
FIG. 1 is a schematic view of a droplet ejection device according to an exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, in this disclosure, the term "sheet" used herein is not limited to a sheet of paper and includes anything such as OHP (overhead projector) sheet, cloth sheet, glass sheet, or substrate on which ink or other liquid droplets can be attached.

The term "ink" is not limited to "ink" in a narrow sense, unless specified, but is used as a generic term for any types of liquid useable as targets of image formation. For example, the term "ink" includes recording liquid, fixing solution, DNA sample, resist, pattern material, resin, and so on.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

FIG. 1 is a schematic view of a configuration of a droplet ejection device according to an exemplary embodiment of this disclosure. In FIG. 1, the droplet ejection device is applied to an inkjet printer serving as an image forming apparatus.

In FIG. 1, the inkjet printer is a serial-type image forming apparatus and has, e.g., an image forming device 2, a sheet feed tray 4, a conveyance device 5, a sheet output section 6, and a sheet output tray 7 in an apparatus body. The sheet feed tray 4 (including a sheet feed cassette and serving as a sheet feed section) is disposed at a lower side of the apparatus body to stack sheets 10 serving as recording media thereon. The conveyance device 5 receives a sheet 10 sent from the sheet feed tray 4 and conveys the sheet 10 in a direction, e.g., a vertical direction, other than a horizontal direction. While the conveyance device 5 intermittently conveys the sheet 10, the image forming device 2 horizontally ejects droplets of ink or other liquid to record a desired image on the sheet 10. The sheet output section 6 feeds the sheet 10 having the image recorded thereon further upward and outputs the sheet 10 to the sheet output tray 7 disposed at an upper side of the apparatus body.

For duplex printing (double-face printing), after printing on one face (front face) of the sheet 10 is finished, a sheet reverse section 8 receives the sheet 10 from the sheet output section 6. While conveying the sheet 10 in the opposite direction (downward direction), the conveyance device 5 turns around and feeds the sheet 10 to the image forming device 2 again so that the image forming device 2 can print on the other face (back face) of the sheet 10. After printing on the other face (back face) ends, the sheet output section 6 outputs the sheet 10 to the sheet output tray 7.

Figure 2:
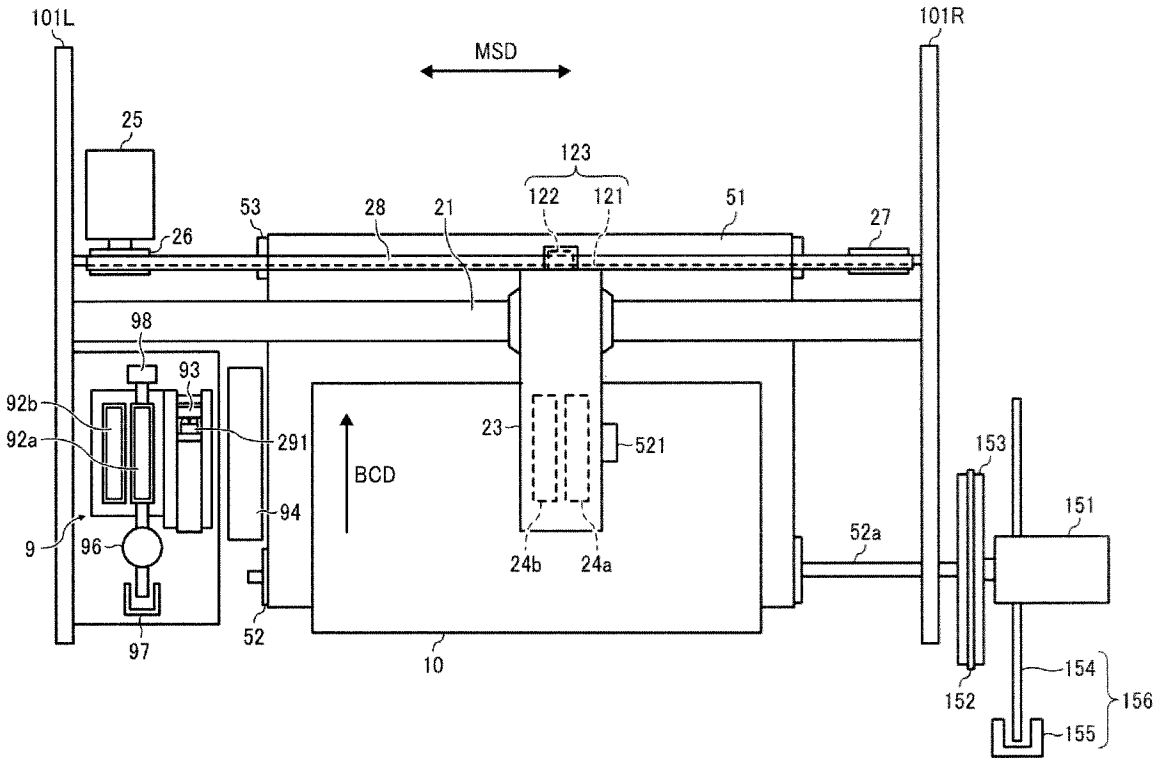
FIG. 2 is a schematic partial view of the droplet ejection device seen from a direction indicated by an arrow A of FIG. 1.

As illustrated in FIG. 2, for the image forming device 2, a carriage 23 mounting recording heads 24*a* and 24*b* (collectively referred to as "recording heads 24" unless distinguished) is slidably supported by a main guide member 21 and a sub guide member 22 extending between a left side plate 101L and a right side plate 101R. The carriage 23 is moved for scanning in a main scanning direction (indicated by an arrow MSD in FIG. 2) by a main scanning motor 25 via a timing belt 28 extending between a driving pulley 26 and a driven pulley 27.

The carriage 23 mounts the recording heads 24*a* and 24*b* serving as droplet ejection heads for ejecting ink droplets of different colors, e.g., yellow (Y), cyan (C), magenta (M), and black (K). The recording heads 24*a* and 24*b* are mounted on the carriage 23 so that multiple nozzles are arrayed in rows in a direction (sub-scanning direction) perpendicular to the main scanning direction, a nozzle face of each recording head in which the nozzles are formed is vertically disposed or slanted relative to the vertical direction, and ink droplets can be ejected from the nozzles in the horizontal direction or a direction tilted relative to the horizontal direction. The direction tilted relative to the horizontal direction means a direction tilted at an angle of 45° or lower from the horizontal direction. The angle of 45° indicates that this exemplary embodiment does not include a configuration in which ink droplets are ejected vertically downward or upward. Such a configuration allows the recording heads 24 to eject liquid droplets from the nozzles of the nozzle face (211A in FIG. 3) in not only the horizontal direction (so-called horizontal ejecting method) but also the direction tilted relative to the horizontal direction.

Figure 3:
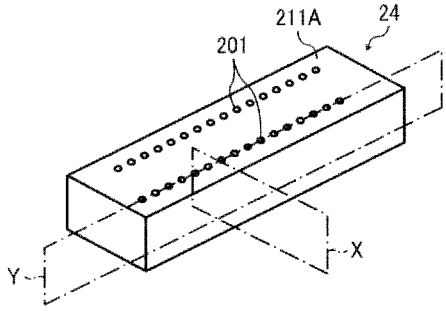
FIG. 3 is a schematic perspective view of a comparative example of a liquid ejection head used in the droplet ejection device of FIG. 1.
Figure 4:
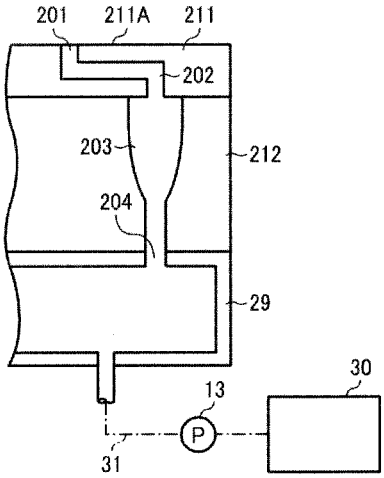
FIG. 4 is a partial cross sectional view of the comparative example of the liquid ejection head cut along a plane X illustrated in FIG. 3.
Figure 5:
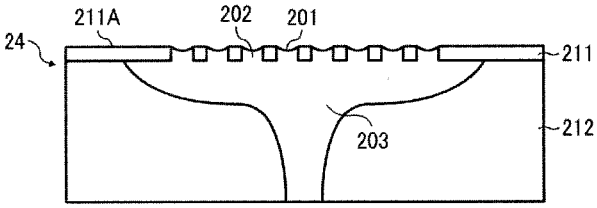
FIG. 5 is a cross sectional view of the comparative example of the liquid ejection head cut along a plane Y illustrated in FIG. 3.

FIGS. 3 to 5 show a configuration of a comparative example of a recording head 24.

FIG. 3 is an external perspective view of a comparative example of a recording head 24. FIG. 4 is a schematic partial cross-sectional view of the comparative example of the recording head 24 cut along an X plane of FIG. 3 (in a direction (short direction) perpendicular to a nozzle array direction in which nozzles are arrayed in row). FIG. 5 is a schematic cross-sectional view of the comparative example of the recording head 24 cut along a Y plane of FIG. 3 (in the nozzle array direction (long direction)).

As illustrated in FIGS. 4 and 5, the comparative example of the recording head 24 has a channel member 211 and a common-chamber member 212. The channel member 211 (see FIG. 4) includes droplet ejection nozzles 201 opened in a nozzle face 211A to eject liquid droplets and individual liquid chambers 202 communicated with the respective droplet ejection nozzles 201. The common-chamber member 212 includes a common liquid chamber 203 and a liquid supply port 204. Ink is supplied from a head tank 29 to the common liquid chamber 203 via the liquid supply port 204. The common liquid chamber 203 supplies ink to the individual liquid chambers 202. In this example, the recording head 24 employs piezoelectric elements as actuators to generate pressure for ejecting liquid droplets in the individual liquid chambers 202. However, it is to be noted that the actuators are not limited to such a piezoelectric type but may be any other suitable type of actuators. The term "chamber" used herein includes "channel or flow channel", i.e. pathway of liquid, and the term "individual liquid chamber" includes, e.g., pressurizing chamber, pressurizing liquid chamber, pressure chamber, and pressure generation chamber.

As pressure generators for generating pressure to eject liquid droplets, the droplet ejection heads forming the recording heads 24 may employ, for example, piezoelectric actuators such as piezoelectric elements, thermal actuators that generate film boiling of liquid (ink) using electro/thermal converting elements such as heat-generation resistant to cause phase change, shape-memory-alloy actuators that change metal phase by a temperature change, or electrostatic actuators that generate pressure by electrostatic force. The carriage 23 may mount, e.g., a droplet ejection head to eject fixing solution that reacts ink to enhance the fixing performance of ink.

The carriage 23 mounts head tanks 29 (see FIG. 1) on the recording heads 24 to supply different color inks to the droplet ejection nozzles 201. As illustrated in FIG. 4, the color inks are supplied from ink cartridges (main tanks) 30 removably mounted in the apparatus body to the head tanks 29 via supply tubes 31.

In FIG. 2, an encoder scale 121 with a certain pattern extends along the main scanning direction MSD of the carriage 23 between the side plates 101L and 101R. The carriage 23 has a first encoder sensor 122 serving as a transmissive photosensor to read a scale (scale index serving as position identifier) of the encoder scale 121. The encoder scale 121 and the first encoder sensor 122 form a linear encoder (main scanning encoder) 123 to detect movement of the carriage 23.

As illustrated in FIG. 2, a maintenance device (maintenance and recovery device) 9 is disposed in a non-printing area (non-recording area) at one end in the main scanning direction MSD of the carriage 23. The maintenance device 9 maintains and recovers conditions of the droplet ejection nozzles 201 of the recording heads 24. The maintenance device 9 includes a suction cap 92*a*, a moisture retention cap 92*b*, a wiping member (wiper blade) 93, and a dummy ejection receptacle 94. The suction cap 92*a* and the moisture retention cap 92*b* (hereinafter collectively referred to as "caps 92" unless distinguished) cap the nozzle faces 211A (see FIG. 3) of the recording heads 24. The wiping member 93 wipes the nozzle faces 211A of the recording heads 24. The first droplet receptacle 94 stores liquid droplets ejected by preliminary ejection (dummy ejection) in which liquid droplets not contributing to image recording is ejected for, e.g., removing viscosity-increased ink. The suction cap 92*a* is connected to a suction pump 96 serving as a suction device, and the suction pump 96 is connected to a waste-liquid tank 97.

In FIG. 1, sheets 10 stacked on the sheet feed tray 4 are separated sheet by sheet by a sheet feed roller 43 of e.g., a half-moon shape and the separation pad 44. The sheets 10 are fed into the apparatus body, are sent along a conveyance guide member 45 to a nipping portion between a conveyance belt 51 and a pressure roller 48 of the conveyance device 5, and are adhered on and conveyed by the conveyance belt 51.

The conveyance device 5 includes, e.g., the conveyance belt 51, a conveyance roller 52, a driven roller 53, a charging roller 54, and a platen member 55. The conveyance belt 51 has an endless shape and is looped around the conveyance roller 52 and the driven roller 53. The charging roller 54 charges the conveyance belt 51. The platen member 55 is disposed at a position opposing the image forming device 2 to maintain the flatness of the conveyance belt 51.

As the conveyance roller 51 is rotated by a sub-scanning motor 151 via a timing belt 152 and a timing pulley 153, the conveyance belt 51 circulates in a belt conveyance direction (also referred to as sub-scanning direction or sheet conveyance direction) indicated by an arrow BCD illustrated in FIG. 2. In the conveyance belt 51, an area from the conveyance roller 52 to the driven roller 53 that opposes the image forming device 2 to adhere the sheet 10 thereon is referred to as "regular conveyance area 51*a*", and an area from the driven roller 53 to the conveyance roller 52 is referred to as "opposite conveyance area 51*b*".

The image forming apparatus further includes a rotary encoder (sub-scanning encoder) 156 to detect the moving distance and position of the conveyance belt 51. The rotary encoder 156 includes a code wheel 154 and a second encoder sensor 155. The code wheel 154 with a predetermined pattern is mounted on a shaft 52*a* of the conveyance roller 52. The second encoder sensor 155 is, e.g., a transmissive photosensor to detect the pattern of the code wheel 154.

The sheet output section 6 includes a sheet output guide member 61, a sheet output transport roller 62, a spur 63, a sheet output roller 64, and a spur 65. A sheet 10 with an image formed thereon is output from between the sheet output roller 64 and the spur 65 onto the sheet output tray 7 in a face down manner.

The sheet reverse section 8 includes a switching claw 81, a reverse guide member 82, a reverse roller 83, a spur 84, an auxiliary conveyance roller 85, the opposite conveyance area 51*b* of the conveyance belt 51, and the bypass guide member 86. The switching claw 81 switches the transport route of a sheet 10 between an output route and a reverse route to reverse the sheet 10 partially projected toward the sheet output tray 7 in a switchback manner and send the sheet 10 to the nipping portion between the conveyance belt 51 and the pressure roller 48 again. The auxiliary conveyance roller 85 opposes the driven roller 53. The bypass guide member 86 guides the sheet 10 separated from the opposite conveyance area 51*b* of the conveyance belt 51 to the nipping portion between the conveyance belt 51 and the pressure roller 48 while bypassing the charging roller 54.

In the image forming apparatus having the above-described configuration, sheet 10 are separated and fed sheet by sheet from the sheet feed tray 4, adhered onto the conveyance belt 51 charged by the charging roller 54, and conveyed in the vertical direction or a direction tilted relative to the vertical direction by the circulation of the conveyance belt 51. By driving the recording heads 24 in response to image signals while moving the carriage 23, ink droplets are ejected onto a sheet 10 stopped to form one line of a desired image. Then, the sheet 10 is fed by a certain distance to prepare for recording another line of the image. After the recording of the full image is finished, the sheet 10 is output to the sheet output tray 7.

In performing maintenance and recovery operation (hereinafter, maintenance operation) of the nozzles 201 of the recording heads 24, the carriage 23 is moved to a home position at which the carriage 23 opposes the maintenance device 9. Then, maintenance operation, such as nozzle suction or dummy ejection, is performed. For nozzle suction, with a nozzle face 211A of a recording head 24 capped with the suction cap 92*a*, ink is sucked from droplet ejection nozzles 201 of the recording head 24 and discharged to, e.g., the waste liquid tank 97. For dummy ejection, as described above, liquid droplets not contributing to image recording are ejected from the nozzles 201. Such maintenance operation allows stable droplet ejection for image formation.

For duplex printing, a first face of a sheet 10 is printed by the above-described operation. When a rear edge of the sheet 10 passes a branching section (the switching claw 81) of the sheet reverse section 8, the sheet output roller 64 is rotated in reverse to switch the sheet 10 back. Further, the sheet 10 is guided along the reverse guide member 82, conveyed to between the reverse roller 83 and the spur 84, and sent into between the opposite conveyance area 51*b* of the conveyance belt 51 and the auxiliary conveyance roller 85.

As a result, the sheet 10 is adhered onto the conveyance belt 51 by static electricity, conveyed by the circulation of the conveyance belt 51, separated from the conveyance belt 51 at the conveyance roller 52, guided by the bypass guide member 85 (via a bypass passage), sent into between the regular conveyance area 51*a* of the conveyance belt 51 and the pressure roller 48, adhered onto the conveyance belt 51, and conveyed again to an image formation area in which image formation is performed by the recording heads 24. After a second face of the sheet 10 is printed, the sheet 10 is output to the sheet output tray 7.

Next, a controller of the image forming apparatus is described with reference to FIG. 6.

Figure 6:
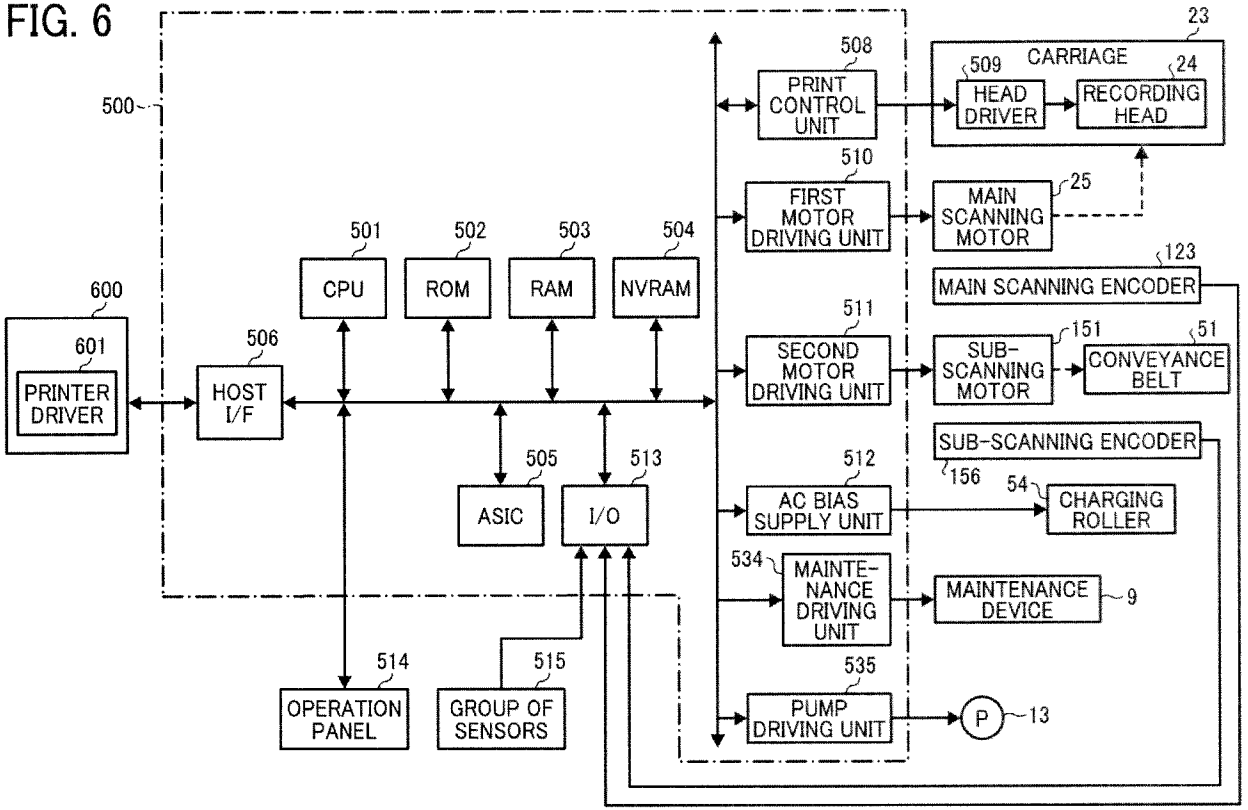
FIG. 6 is a block diagram of a controller used in the droplet ejection device illustrated in FIG. 1.

In FIG. 6, a controller 500 includes a central processing unit (CPU) 501, a read-only memory (ROM) 502, a random access memory (RAM) 503, a rewritable non-volatile random access memory (NVRAM) 504, and an application specific integrated circuit (ASIC) 505. The CPU 501 controls the entire image forming apparatus. The ROM 502 stores programs, including programs causing the CPU 501 to perform control processing according to exemplary embodiments described below, and other fixed data. The RAM 503 temporarily stores image data or other data. The rewritable NVRAM 504 retains data even while the apparatus is powered off. The ASIC 505 processes signals for image data, performs image processing, e.g., sorting, or processes input and output signals for controlling the entire image forming apparatus.

The controller 500 also has a print control unit 508, a head driver (driver integrated circuit) 509, a first motor driving unit 510, a second motor driving unit 511, and an alternating current (AC) bias supply unit 512. The print control unit 508 includes a data transmitter and a driving signal generator to drive and control the recording heads 24 according to print data. The head driver 509 drives the recording heads 24 mounted on the carriage 23. The first motor driving unit 510 drives the main scanning motor 25 to move the carriage 23 for scanning. The second motor driving unit 511 drives the sub-scanning motor 151 to circulate the conveyance belt 51. The AC bias supply unit 512 supplies AC bias to the charging roller 54.

The controller 500 is connected to an operation panel 514 for inputting and displaying information necessary to the image forming apparatus.

The controller 500 further includes a host interface (I/F) 506 to transmit and receive data and signals to and from a host 600, such as an information processing device (e.g., personal computer), image reading device (e.g., image scanner), or image capturing device (e.g., digital camera) via a cable or network.

The CPU 501 of the controller 500 reads and analyzes print data stored in a reception buffer of the host I/F 506, performs desired image processing, data sorting, or other processing with the ASIC 505, and transfers image data to the head driver 509. It is to be noted that dot-pattern data for image output may be created by a printer driver 601 of the host 600.

The print control unit 508 transfers the above-described image data as serial data and outputs to the head driver 509, for example, transfer clock signals, latch signals, and control signals required for the transfer of image data and determination of the transfer. In addition, the print control unit 508 has the driving signal generator including, e.g., a digital/analog (D/A) converter (to perform digital/analog conversion on pattern data of driving pulses stored on the ROM 502), a voltage amplifier, and a current amplifier, and outputs a driving signal containing one or more driving pulses to the head driver 509.

In accordance with serially-inputted image data corresponding to one image band recorded by the recording heads 24, the head driver 509 selects driving pulses forming driving signals transmitted from the print control unit 508 and applies the selected driving pulses to driving elements (e.g., piezoelectric elements) to drive the recording heads 24. At this time, the driving elements serve as pressure generators to generate energy for ejecting liquid droplets from the recording heads 24. At this time, by selecting driving pulses constituting driving signals, liquid droplets of different liquid amounts, such as large-size droplets, medium-size droplets, and small-size droplets, can be selectively ejected to form different sizes of dots.

An input/output (I/O) unit 513 acquires information from the main scanning encoder 123, the sub-scanning encoder 156, and a group of sensors 515 installed in the image forming apparatus, extracts information required for controlling printing operation, and controls the print control unit 508, the first motor driving unit 510, the second motor driving unit 511, and the AC bias supply unit 512 based on the extracted information. The group of sensors 515 includes, for example, an optical sensor (sheet sensor) 521 disposed at the carriage 23 to detect the position of a sheet 10, a thermistor to monitor temperature and humidity in the apparatus body, a voltage sensor to monitor the voltage of the charged conveyance belt, and an interlock switch to detect the opening and closing of a cover. The I/O unit 513 is capable of processing information from such various types of sensors.

For example, the CPU 501 determines a driving output value (control value) for the main scanning motor 25 based on a detected speed value and a detected position value obtained by sampling detected pulses transmitted from the first encoder sensor 122 constituting the main scanning encoder 123 and a target speed value and a target position value obtained from preliminarily-stored speed and position profiles. Further, based on the driving output value, the CPU 501 drives the main scanning motor 25 via the first motor driving unit 510. Similarly, the CPU 501 determines a driving output value (control value) for the sub-scanning motor 151 based on a detected speed value and a detected position value obtained by sampling detected pulses transmitted from the second encoder sensor 155 constituting the sub-scanning encoder 156 and a target speed value and a target position value obtained from preliminarily-stored speed and position profiles. Further, based on the driving output value, the CPU 501 drives the sub-scanning motor 151 via the second motor driving unit 511.

The controller 500 drives the maintenance device 9 via a maintenance driving unit 534 to move the caps 92 back and forth with respect to the nozzle faces 211A of the recording heads 24, move the wiping member 94, and drive the suction pump 96. By driving a supply pump 13 with a pump driving unit 535, ink is delivered from the main tanks 30 to the head tanks 29 or in reverse from the head tanks 29 to the main tanks 30.

A droplet ejection device according to an exemplary embodiment usable in the image forming apparatus having the above-described configuration is described below.

Figure 7:
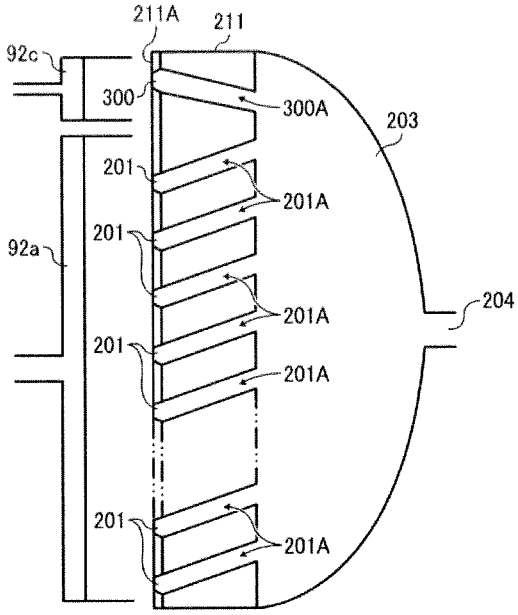
FIG. 7 is a cross sectional view of a liquid ejection head of a droplet ejection device according to an exemplary embodiment of this disclosure.

FIG. 7 is a schematic cross sectional view of a recording head 24 according to an exemplary embodiment of this disclosure.

In the recording head 24 illustrated in FIG. 7, a nozzle face 211A having openings of droplet ejection nozzles 201 is disposed in a vertical direction, which is one of directions other than a horizontal direction, so as to eject liquid droplets in the horizontal direction, and the droplet ejection nozzles 201 are arrayed side by side in the vertical direction. It is to be noted that the orientation of the nozzle face 211A is not limited to the above-described vertical direction but may be tilted relative to the vertical direction so that liquid droplets are ejected from the droplet ejection nozzles 201 in a direction tilted relative to the horizontal direction.

For the recording head 24 illustrated in FIG. 7, the droplet ejection nozzles 201 and channels 201A communicating with the droplet ejection nozzles 201 are formed in a channel member 211. The channels 201A serving as individual liquid chambers (corresponding to the individual liquid chambers 202 in FIG. 4) are tilted downward so that a side proximal to the nozzle face 211A is lower than a side proximal to a common liquid chamber 203.

Above an upmost one of the droplet ejection nozzles 201 arrayed side by side in the vertical direction, an air vent nozzle 300 is disposed to induct not liquid droplets but bubbles. For the air vent nozzle 300, unlike the droplet ejection nozzles 201, a channel 300A is tilted upward so that an opening at a side proximal to the nozzle face 211A is higher than a side proximal to the common liquid chamber 203. The configuration of the air vent nozzle 300 is intended to facilitate movement of bubbles by flotation, and the tilt angle of the channel 300A is set to an angle at which bubbles can move most smoothly. As illustrated in FIG. 7, ink or other liquid is supplied to the common liquid chamber 203 through a supply port 204.

In the droplet ejection head having the above-described configuration, ink is introduced to the individual liquid chambers (the channels 201A) in the channel member 211 and the common liquid chamber 203 communicating with the individual liquid chambers. Bubbles mixed into the common liquid chamber 203 move upward by flotation and toward the air vent nozzle 300 communicating with the common liquid chamber 203.

Regarding the configuration of the channels 201A, as described above, each droplet ejection nozzle 201 is tilted downward so that an opening at the side proximal to the nozzle face 211A is lower than the side proximal to the common liquid chamber 203. Such a configuration prevents bubbles moving upward by flotation from intruding from the common liquid chamber 203 to the droplet ejection nozzles 201. Even if the bubbles intrude to the droplet ejection nozzles 201, such a configuration facilitates the bubbles to exit from the droplet ejection nozzles 201 by flotation. As a result, bubbles mixed into liquid (ink) supplied from the common liquid chamber 203 hardly intrude into the droplet ejection nozzles 201, move upward in the common liquid chamber 203, and move toward the air vent nozzle 300.

Bubbles moving toward the air vent nozzle 300 accumulate at an upper portion of the common liquid chamber 203 and exit from the air vent nozzle 300 to the outside. As a result, since bubbles in the common liquid chamber 203 move by flotation into not the droplet ejection nozzles 201 but the air vent nozzle 300 at the upper portion of the droplet ejection nozzles 201, a state in which bubbles are not mixed into ink in the droplet ejection nozzles 201 can be maintained.

The above-described configuration can reliably discharge, to the outside, bubbles moving toward the droplet ejection nozzles 201 unlike a configuration in which, e.g., a filter is provided to move bubbles from a surface opposing the droplet ejection nozzles 201 to other storage point. As a result, bubbles do not stay in the channel member 211 and the droplet ejection nozzles 201, thus preventing ejection failure or faulty image formation due to bubbles.

Figure 8:
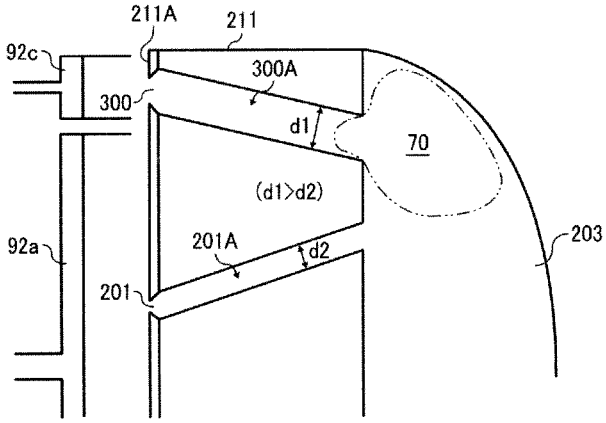
FIG. 8 is an enlarged view of a portion of the liquid ejection head illustrated in FIG. 7.

Next, a variation of the configuration of the recording head 24 illustrated in FIG. 7 is described below with reference to FIG. 8.

In this variation, an air vent nozzle 300 has a lower flow resistance to liquid flow than droplet ejection nozzles 201. FIG. 8 shows an example of a recording head 24 in this variation. In FIG. 8, a channel 300A of the air vent nozzle 300 has a greater capacity than a channel 201A of a droplet ejection nozzle 201.

As the configuration in which the air vent nozzle 300 has a lower flow resistance, besides the above-described configuration, for example, a diameter d1 of the channel 300A of the air vent nozzle 300 is set to be greater than a diameter d2 of the channel 201A of the droplet ejection nozzle 201. In addition, in the air vent nozzle 300, an opening proximal to the common liquid chamber 203 may have an area greater than an opening proximal to the nozzle face 211A.

Next, another variation of the configuration of the recording head 24 illustrated in FIG. 7 is described below with reference to FIG. 9.

Figure 9:
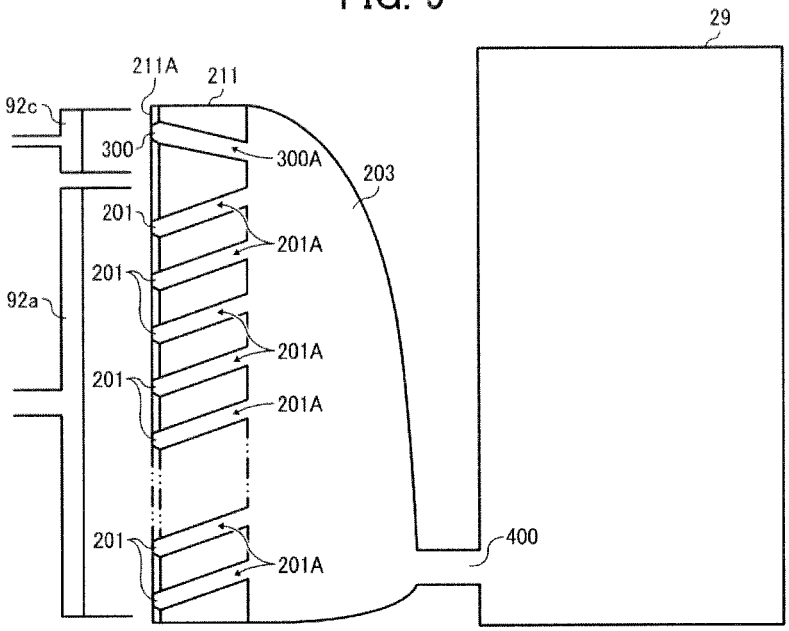
FIG. 9 is a schematic view of a variation of the liquid ejection head illustrated in FIG. 7.

This variation illustrated in FIG. 9 differs from the configuration illustrated in FIG. 7 in a connecting structure of a common liquid chamber 203 of a recording head 24 and a head tank 29 that supplies different color inks to droplet ejection nozzles 201 of the recording head 24.

FIG. 9 shows a connecting portion of the common liquid chamber 203 of the recording head 24 and the head tank 29 that supplies different color inks to the droplet ejection nozzles 201 of the recording head 24.

In FIG. 9, the common liquid chamber 203 is connected to the head tank 29 via an inlet 400 disposed at a position lower than a middle position of the common liquid chamber 203 in a vertical direction.

Such a configuration allows bubbles in ink or other liquid stored in the head tank 29 to move upward by flotation, thus preventing bubbles from staying around a bottom portion of the head tank 29.

Thus, since ink or other liquid is introduced from the head tank 29 to the common liquid chamber 203 via the inlet 400 disposed at the position lower than the middle position in the vertical direction, bubbles move to an upper portion of the head tank 29 and only ink or other liquid flows into the inlet 400. As a result, the liquid introduced in the common liquid chamber 203 does not contain bubbles, thus preventing bubbles from moving into the droplet ejection nozzles 201.

Next, an air vent process performed by the controller illustrated in FIG. 6 is described below.

The group of sensors 515 connected to the controller 500 illustrated in FIG. 6 includes an empty sensor to detect whether or not ink or other liquid supplied to the droplet ejection nozzles 201 of the recording head 24 is at a predetermined amount or lower.

Figure 10:
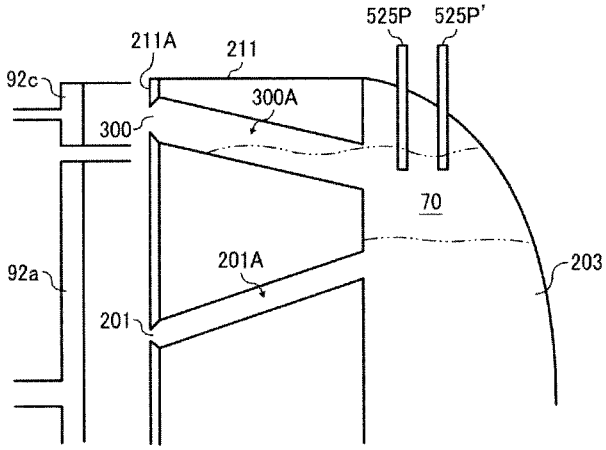
FIG. 10 is a schematic view of another variation of the liquid ejection head illustrated in FIG. 7.

In FIG. 10, the empty sensor includes conductive members, e.g., paired electrode plates 525P and 525P' disposed adjacent to an opening of an air vent nozzle 300 proximal to the common liquid chamber 203. When the electrode plates 525P and 525P' lose contact with ink, the empty sensor outputs a signal indicating that ink is at the predetermined amount or lower.

Besides detecting that ink is at the predetermined amount or lower, the empty sensor also detects whether or not bubbles 70 fill the air vent nozzle 300 and spread to the common liquid chamber 203.

In this configuration, during execution of a sequence program of printing processing in the controller 500 or at start up of the image forming apparatus, the air vent process is performed.

Figure 11:
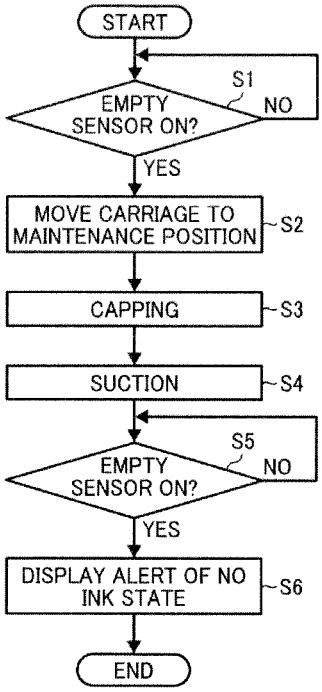
FIG. 11 is a flowchart of a procedure of an air vent process performed by the controller illustrated in FIG. 6.

FIG. 11 is a flowchart of a procedure of the air vent process in this exemplary embodiment.

In FIG. 11, at S1, the controller 500 determines whether or not the controller 500 receives a signal input from the empty sensor, i.e., the empty sensor is turned on. When the controller 500 receives the signal input from the empty sensor (YES at S1), at S2 the controller 500 moves the carriage 23 to a maintenance position at which the carriage 23 opposes the maintenance device 9.

Besides the suction cap 92*a* for the droplet ejection nozzles 201, the maintenance device 9 has an air vent cap 92*c* (see FIGS. 7 to 10) dedicated for the air vent nozzle 300 to cap the air vent nozzle 300 concurrently with the operation of the suction cap 92*a* relative to the droplet ejection nozzles 201.

In FIG. 11, at S3, the maintenance device 9 caps the air vent nozzle 300 with the air vent cap 92*c*. Like the action on the droplet ejection nozzles 201, with the air vent cap 92*c* contacting the air vent nozzle 300, at S4 air is vented from the air vent nozzle 300 to the waste-liquid tank 97 (illustrated in FIG. 2) by sucking operation of the suction pump 96 (illustrated in FIG. 2).

After sucking operation of the suction pump 96 for air vent is finished, at S5 the controller 500 determines whether or not the controller 500 receives a signal input from the empty sensor. If the controller 500 receives a signal input from the empty sensor, i.e., the empty sensor is turned on (YES at S5), it is assumed that ink or other liquid is at the predetermined amount or lower. Then, at S6, the controller displays an alert of no ink state on the operation panel 514 (see FIG. 6).

As described above, in this exemplary embodiment, the recording head 24 has the air vent nozzle 300 besides the droplet ejection nozzles 201. Such a configuration prevents bubbles from staying in the common liquid chamber 203 and discharges bubbles to the outside through the air vent nozzle 300. As a result, the suction pump 96 used for sucking ink or other liquid can be also used for venting air. Such a configuration can prevent bubbles from mixing into the droplet ejection nozzles 201 in a simple structure, thus preventing ejection failure or faulty image formation due to bubbles.

In addition, the air vent nozzle 300 requires no special channel configuration and can have the same channel length as the droplet ejection nozzles 201. Thus, even if the channel 300A is provided as a channel for air venting, air venting can be smoothly performed without increasing the flow resistance of the channel.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A droplet ejection device comprising a droplet ejection head, the droplet ejection head comprising a plurality of droplet ejection nozzles arranged side by side in a vertical direction, each of the plurality of droplet ejection nozzles having a first channel to eject droplets of liquid to a target, a common liquid chamber communicated with the first channel of the each of the plurality of droplet ejection nozzles to supply the liquid to the first channel of the each of the plurality of droplet ejection nozzles, an air vent nozzle having a second channel to vent air from the common liquid chamber, and a nozzle face including the plurality of droplet ejection nozzles and the air vent nozzle, the nozzle face disposed in the vertical direction or a direction tilted downward relative to the vertical direction so that droplets of the liquid are ejected from the plurality of droplet ejection nozzles in a horizontal direction or in a direction tilted relative to the horizontal direction, wherein the first channel is tilted downward so that a side of the each of the plurality of droplet ejection nozzles proximal to the nozzle face is lower than another side of the each of the plurality of droplet ejection nozzles proximal to the common liquid chamber, the air vent nozzle is disposed above a topmost one of the plurality of droplet ejection nozzles, and the second channel is tilted upward so that a side of the air vent nozzle proximal to the nozzle face is higher than another side of the air vent nozzle proximal to the common liquid chamber, and wherein the air vent nozzle has a lower flow resistance to flow of the liquid than the each of the plurality of droplet ejection nozzles.

2. The droplet ejection device of claim 1, wherein the second channel of the air vent nozzle has a capacity greater than the first channel of the each of the plurality of droplet ejection nozzles.

3. The droplet ejection device of claim 1, wherein the second channel of the air vent nozzle has a cross sectional diameter greater than the first channel of the each of the plurality of droplet ejection nozzles.

4. The droplet ejection device of claim 1, further comprising a tank to supply the liquid to the common liquid chamber and a connecting portion to connect the tank to the common liquid chamber, wherein the connecting portion is disposed at a position lower than a middle position of the common liquid chamber in the vertical direction.

5. The droplet ejection device of claim 1, wherein the droplet ejection head is movable to a maintenance position differing from a droplet ejecting position at which the droplet ejection head ejects droplets of the liquid to the target, and the droplet ejection device further comprises a suction cap to cap at least a portion of the plurality of droplet ejection nozzles of the droplet ejection head at the maintenance position and an air vent cap to cap the air vent nozzle of the droplet ejection head at the maintenance position.

* * * * *